US005427246A

United States Patent [19]

Hadjikhani

[11] Patent Number: 5,427,246

[45] Date of Patent: Jun. 27, 1995

[54] SHOPPING BAG STORAGE TUBE

[76] Inventor: George Hadjikhani, 22121 Cantlay St., Canoga Park, Calif. 91303

[21] Appl. No.: 308,840

[22] Filed: Sep. 19, 1994

[51] Int. Cl.[6] ..... B65D 88/58

[52] U.S. Cl. ..... 206/554; 206/499; 220/375; 221/279

[58] Field of Search ..... 206/554, 499, 804, 817; 220/578, 375; 221/56, 279; 222/405, 392

[56] References Cited

U.S. PATENT DOCUMENTS

| | | | |
|---|---|---|---|
| 522,693 | 7/1894 | McLaughlin . | |
| 1,468,152 | 9/1923 | Hemstreet . | |
| 2,036,549 | 4/1936 | Smith | 215/100 |
| 2,314,261 | 3/1943 | Younghusband | 206/56 |
| 2,563,251 | 8/1951 | Lanahan | 222/322 |
| 2,830,731 | 4/1958 | Munao | 222/78 |
| 3,080,154 | 3/1963 | Tanner | 261/30 |
| 3,269,613 | 8/1966 | Nickas | 222/392 |
| 3,727,793 | 4/1973 | Staubly | 220/578 |
| 5,183,157 | 2/1993 | Darden | 206/554 X |

*Primary Examiner*—Jacob K. Ackun

*Attorney, Agent, or Firm*—Cislo & Thomas

[57] ABSTRACT

A grocery bag storage tube for the convenient storage and retrieval of plastic grocery bags. A hollow tube of appropriate diameter has a sturdy and weighty base holding the hollow tube upright. Within the confines of the hollow tube, a weighted plug capable of slidable travel within the interior of the hollow tube is connected as by cords to a cap and to the bottom end of the hollow tube. Plastic grocery bags may be inserted into the hollow tube above the plug once the cap has been removed. Removal of plastic grocery bags is effected by pulling the cap away from the top end of the hollow tube. As the cap is displaced away from the top end of the hollow tube, it pulls the plug with it. Any plastic bags inside the hollow tube between the plug and the cap are urged outwards towards the mouth of the tube by the plug. The plastic bags are then easily retrieved by pulling them from the hollow tube as they emerge therefrom. In an alternative embodiment, the sturdy base may be eliminated, allowing attachment of the grocery bag storage tube to another stationery object, such as the interior of the kitchen cabinet.

11 Claims, 1 Drawing Sheet

SHOPPING BAG STORAGE TUBE

BACKGROUND OF THE INVENTION

1. Field of the Invention

The present invention relates to the storage of plastic grocery bags, and more particularly to a receptacle into which such grocery bags may be stuffed then easily retrieved.

2. Description of the Related Art

For many years, grocery stores and other retailers have used paper bags as disposable containers into which purchased items may be placed and held, allowing shoppers to leave the store with their purchased items. Over the past ten years or so, thin bags of plastic having two apertures forming a handle have been used instead of paper for shoppers' bags. These newer plastic bags are more easily packaged and shipped as they occupy less volume when folded than do the old paper bags. In fact, these plastic bags have generally replaced paper bags in most urban areas.

Paper grocery bags have several folds or creases preformed so that they fold flat and occupy less space. The paper forming the bag is sufficiently stiff to provide some support for the bag when opened and to hold the preformed creases. When paper grocery bags are folded flat, they are easily stored for retrieval in some convenient place. One common use for paper grocery bags is the temporary storage of trash until delivered via the bag to a larger garbage receptacle.

As opposed to the older paper bags, the newer plastic grocery bags are made out of a thin but strong plastic material that does not hold a crease as well. Furthermore, such thin plastic grocery bags do not have the ability to support themselves upright. While the newer, thin plastic grocery bags are able to contain a heavy object without breaking, even when wet, they are not easily folded into a flat and compact space for easy storage. In fact, it is more easy to stuff the bags away in some manner as the thin plastic material is easily compressed and crumpled while maintaining its tensile strength.

In the past, it has been possible to temporarily store such thin plastic grocery bags in another plastic grocery bag or to stuff them into a conveniently available place for later retrieval. It has not been possible to store the bags in a convenient enclosure if such enclosure took the bags out of reach. While the bags would be conveniently stored, it was unfortunately impossible or very difficult to retrieve them. Without a receptacle in which to store and to retrieve such bags, it is inconvenient and somewhat messy to have a number of used grocery bags stuffed awkwardly and arbitrarily into some corner, drawer, or cupboard.

It can be seen, that there is a need for a convenient and easily used container that would allow the storage of several thin plastic grocery bags that allows them to be retrieved as easily as they are stored.

SUMMARY OF THE INVENTION

The present invention allows the easy storage and retrieval of thin plastic grocery bags often used throughout the United States, especially in its urban areas. A long cylindrical tube approximately 3 feet high and 3 to 4 inches in diameter provides storage space for the plastic grocery bags. The long cylindrical tube is held upright by a sturdy base or can be attached to some other stationery item such as the inside of a kitchen cupboard or the like. A removable cap snugly fits on top of the top end of the cylindrical tube. The bottom end of the cylindrical tube is sealed so that no bags can pass through the bottom.

Inside the cylindrical tube is a weighted cylindrical plug. The weighted plug slides up and down within the interior of the cylindrical tube. One cord connects the weighted plug to the cap and another cord connects the weighted plug to a fixed point at or near the bottom of the cylindrical tube. Plastic bags are stuffed into the interior of the cylindrical tube above the sliding plug and about the top cord. The tube may then be covered by the cap. In order to retrieve bags stuffed inside the cylindrical tube, the cap is pulled away from the top of the tube. The cord connected to the cap pulls upon the weighted plug to force or urge the plastic grocery bags out the open end of the cylindrical tube for easy retrieval.

The cylindrical tube may be other lengths than 3 ft. A diminutive version may be more advantageous when the present invention is attached to the interior of a kitchen cupboard. The cords used in the present invention are of a length such that they allow the weighted plug to travel as far as possible along the major axis of the cylindrical tube. In this way, most if not all of the interior space of the cylindrical tube can be used to store as many plastic grocery bags as possible.

The base used to stabilize the cylindrical tube maybe a hollow vessel filled with cement or other heavy material. The bottom end of the cylindrical tube may be attached as by screws to the base. It is contemplated that the present invention may be made of PVC or other easily crafted plastic or other material.

It is an object of the present invention to provide means by which plastic grocery bags may be easily stored and retrieved.

It is another object of the present invention to provide such plastic bag storage means that can be fabricated at a low price.

It is yet another object of the present invention to provide easy retrieval means for otherwise inaccessibly stored plastic bags.

It is yet another object of the present invention to provide such storage means for plastic bags that can be easily used in the home.

These and other objects and advantages of the present invention will be apparent from a review of the following specification and accompanying drawings.

DESCRIPTION OF THE PREFERRED EMBODIMENT(S)

Figure 1:
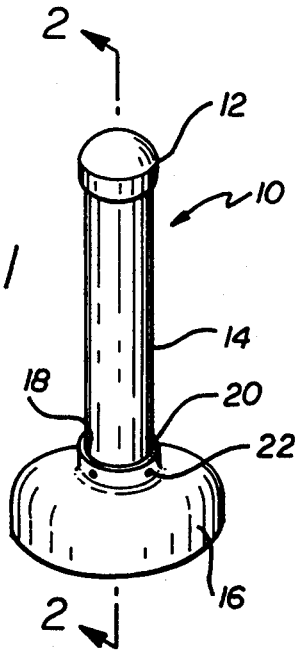
FIG. 1 shows in perspective view a free standing plastic grocery bag storage means as provided for by the present invention.

As shown in FIG. 1, an exterior inspection of the grocery bag storage tube 10 of the present invention reveals the grocery bag storage tube 10 as having a cap 12 fitting on top of a hollow tube 14. The bottom end of the hollow tube 14 fits into a base 16 through an aperture 18 centrally formed from the base 16. The aperture 18 has a flange 20 that extends upwardly to receive the bottom end of the hollow tube 14. The bottom end of the hollow tube 14 fits snugly within the flange 20 and screws 22 or other similar fasteners may be used to attach the hollow tube 14 to the base 16.

From inspection of FIG. 1 it can be seen that the base 16 provides a wide area upon which the hollow tube 14 is supported. This allows the hollow tube to be bumped or knocked about without tipping over.

Figure 2:
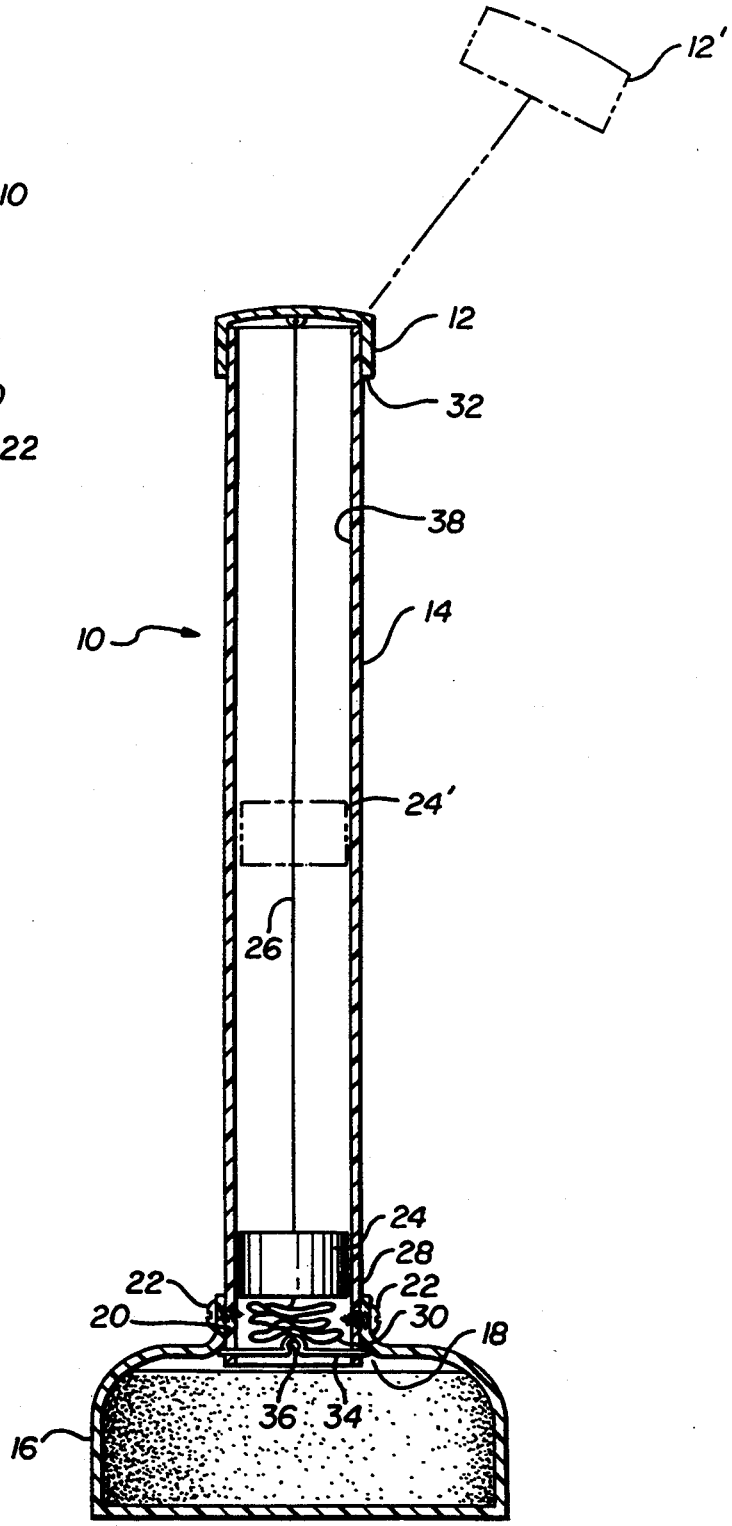
FIG. 2 shows in cross-section the grocery bag storage tube of FIG. 1, the view taken generally along line 2—2 of FIG. 1. The slidable weighted plug, the removable cap, and an associated cord are shown in phantom.

As shown in FIG. 2, the interior operating portion of the grocery bag storage tube 10 has a plug 24. The plug 24 is made of lead or other dense or heavy materials so that it has a tendency to drop down as far as possible within the interior of hollow tube 14. The plug 24 is connected by a top cord 26 to the cap 12. The plug 24 is also connected to the bottom end 28 of the hollow tube 14 by a bottom cord 30. The weight of plug 24 holds the cord 26 taut and helps to keep cap 12 securely secured to the top end 32 of the hollow tube 14.

In order to connect the cord 30 to the bottom end 28 of the hollow tube 14, a wire 34 may be attached across the bottom end 28 of the hollow tube 14. The wire 34 may have a small loop 36 to which the cord 30 may be attached. The other end of cord 30 may be attached to the bottom end of plug 24. It is also contemplated that a single cord may be used that runs through the plug 24. In such a case, the plug 24 would be connected to the middle of the integral cord.

The cords 26 and 30 are of a length that allow the plug 24 to travel as far as possible within the interior 38 of the hollow tube 14. To achieve such extensive travel of the plug 24, the cords 26 and 30 should be slightly less long than the length of the hollow tube 14.

The bottom end 28 of the hollow tube 14 fits into a sturdy base 16. The sturdy base 16 is preferably very heavy to bring the center of mass of the entire grocery bag storage tube of the present invention as conveniently near to the ground as possible which prevents the tube from tipping over. To achieve this, the interior of the base 16 may be filled with cement, sand, or other heavy materials. An aperture 18 is present at the top of the base 16. The aperture 18 engages the bottom end 28 of the hollow tube 14 through flange 20. Flange 20 surrounds the bottom end 28 of the hollow tube 14. The bottom end 28 may be secured to the flange by means of screws 22. Other means for securing the bottom end 28 of the hollow tube 14 may also be used to secure it to the base 16.

Use of the grocery bag storage tube 10 of the present invention is effected by first removing the cap 12 and pulling it away from the open top end 32 of the hollow tube 14. As cord 26 is connected to the cap 12, it pulls upon the plug 24 as the cap 12 is pulled away from the top end 32. As shown in phantom in FIG. 2, the cap 12 pulls the plug 24 up and away from the bottom end 28 of the hollow tube 14 as the cap 12 is pulled upward away from the top end 32. Phantom cap 12' and phantom plug 24' indicate the travel of the plug 24 as the cap 12 is pulled away from the grocery bag storage tube 10. The slidable nature of the plug 24 within the interior 38 of hollow tube 14 allows the plug 24 to freely travel within the interior 38. The only restriction upon the upward travel of plug 24 is the bottom cord 30. As the plug 24 nears the top end 32 of hollow tube 14, the bottom cord 30 grows taut and prevents the plug 24 from traveling out of the hollow tube 14. In this way, the plug 24 is constrained to travel within the confines of interior 38 of hollow tube 14 which conveniently prevents the plug 24 from escaping the hollow tube 14.

The plug 24 is such that it can not flip, turn, twist or otherwise maneuver itself within the confines of the tube interior 38. To achieve this, the length of the plug 24 should be at least a few inches so that it occupies a cylindrical length inside the hollow tube 14. The plug 24 freely and slidably fits within the interior 38, but not so close as to experience a snug or tight fit within the interior 38.

Once the cap 12 has been removed from the top end 32, plastic grocery bags may be stuffed into the open mouth of the hollow tube 14. It is this use of the grocery bag storage tube 10 that dictates the preferred dimensions of the hollow tube 14. The diameter of hollow tube 14 should be sufficient to allow easy access and withdrawal of the grocery bags without having too much or too little space. The plastic grocery bags should touch the interior 38 so that there is some frictional contact between the bags and the interior 38 of the hollow tube 14. The diameter of hollow tube 14 should be such that it is easy to stuff plastic grocery bags within the interior 38. Should several plastic grocery bags be inserted into the interior 38 at one time, the person using the grocery bags storage tube 10 can force (by pushing) the plastic grocery bags deeper into the interior 38. When all of the plastic grocery bags to be stored have been inserted into the interior 38, the cap 12 is then replaced upon the top end 32 of the hollow tube 14 to conveniently seal the grocery bag storage tube 10. The cap 12 may fit snugly upon the top end 32 of the hollow tube 14 and is also held in place by the weight of plug 24.

In order to retrieve the plastic grocery bags stuffed into the interior 38 of the hollow tube 14, a person needs but to lift the cap 12 up and away from the top end 32 of the hollow tube 14. In doing so, the plug 24 follows the cap 12 along the path defined by the hollow tube 14. The top cord 26 pulls the plug 24 upwards as the cap 12 is increasingly removed from the top end 32 of the hollow tube 14. Any plastic grocery bags present between the top of the plug 24 and the top end 32 of the hollow tube 14 are urged or forced towards the mouth of the hollow tube 14 by the plug 24 as the cap 12 is increasingly pulled away from the top end 32. This allows easy means by which bags stuffed deep within the interior 38 of the hollow tube 14 may be retrieved. The plug 24 can not inconveniently escape from the interior 38 as the bottom cord 30 constrains the travel of the plug 24 to within the interior 38 of the hollow tube 14.

It should be noted that the plug 24 is of sufficient diameter so as to prevent any plastic grocery bags stuffed within the interior 38 from traveling past it towards the bottom end 28 of the hollow tube 14.

While the present invention has been described with regards to particular embodiments, it is recognized that additional variations of the present invention may be devised without departing from the inventive concept.

What I claim is:

1. A grocery bag storage tube for the storage of plastic grocery bags and the like, comprising:

a hollow tube having a bottom end and a top end;

a plug, said plug slidably engaging the interior of said hollow tube;

a first cord, said first cord coupled to said bottom end of said hollow tube and attached to said plug, said first cord constraining the movement of said plug away from said bottom end of said hollow tube; and a second cord, said second cord attached to said plug, said second cord constraining the movement of said plug away from said top end of said hollow tube.

2. The grocery bag storage tube of claim 1, further comprising:

a cap, said cap fitting over said top end of said hollow tube, said second cord attached to said cap.

3. The grocery bag storage tube of claim 1, further comprising:

a sturdy base, said sturdy base attached to said bottom end of said hollow tube whereby said grocery bag storage tube is sturdily maintained in an upright position.

4. The grocery bag storage tube of claim 1, further comprising:

a wire, said wire attached across the interior of said bottom end of said hollow tube, said first cord attached to said wire thereby coupling said first cord to said bottom end of said hollow tube.

5. The grocery bag storage tube of claim 1, further comprising:

said plug obstructing the interior of said hollow tube whereby grocery bags stuffed inside of said tube cannot slip past said plug towards said bottom end of said hollow tube.

6. The grocery bag storage tube of claim 1 wherein said first and second cords are of a length slightly smaller than the length of said tube, whereby said plug cannot slide out an end of said tube.

7. A grocery bag storage tube for the storage of plastic grocery bags and the like, comprising:

a hollow tube having a bottom end and a top end;

a plug, said plug slidably engaging the interior of said hollow tube, said plug obstructing the interior of said hollow tube whereby grocery bags stuffed inside of said tube cannot slip past said plug towards said bottom end of said hollow tube;

a first cord, said first cord coupled to said bottom end of said hollow tube and attached to said plug, said first cord constraining the movement of said plug away from said bottom end of said hollow tube;

a second cord, said second cord attached to said plug, said second cord constraining the movement of said plug away from said top end of said hollow tube; and a cap, said cap fitting over said top end of said hollow tube, said second cord attached to said cap.

8. The grocery bag storage tube of claim 7, further comprising:

a sturdy base, said sturdy base attached to said bottom end of said hollow tube whereby said grocery bag storage tube is sturdily maintained in an upright position.

9. The grocery bag storage tube of claim 7, further comprising:

a wire, said wire attached across the interior of said bottom end of said hollow tube, said first cord attached to said wire thereby coupling said first cord to said bottom end of said hollow tube.

10. The grocery bag storage tube of claim 7 wherein said first and second cords are of a length slightly smaller than the length of said tube, whereby said plug cannot slide out an end of said tube.

11. A grocery bag storage tube for the storage of plastic grocery bags and the like, comprising:

a hollow tube having a bottom end and a top end;

a plug, said plug slidably engaging the interior of said hollow tube, said plug obstructing the interior of said hollow tube whereby grocery bags stuffed inside of said tube cannot slip past said plug towards said bottom end of said hollow tube;

a first cord, said first cord coupled to said bottom end of said hollow tube and attached to said plug, said first cord constraining the movement of said plug away from said bottom end of said hollow tube;

a second cord, said second cord attached to said plug, said second cord constraining the movement of said plug away from said top end of said hollow tube, said first and second cords of a length slightly smaller than the length of said tube, whereby said plug cannot slide out an end of said tube;

a cap, said cap fitting over said top end of said hollow tube, said second cord attached to said cap;

a sturdy base, said sturdy base attached to said bottom end of said hollow tube whereby said grocery bag storage tube is sturdily maintained in an upright position; and a wire, said wire attached across the interior of said bottom end of said hollow tube, said first cord attached to said wire thereby coupling said first cord to said bottom end of said hollow tube.

* * * * *